US006805910B1

(12) United States Patent
Anderson

(10) Patent No.: US 6,805,910 B1
(45) Date of Patent: Oct. 19, 2004

(54) PROCESS FOR APPLYING COATINGS

(75) Inventor: Richard N. Anderson, Whitesville, KY (US)

(73) Assignee: Hunter Douglas, Inc., Upper Saddle River, NJ (US)

( * ) Notice: Subject to any disclaimer, the term of this patent is extended or adjusted under 35 U.S.C. 154(b) by 29 days.

(21) Appl. No.: 10/232,452

(22) Filed: Aug. 30, 2002

Related U.S. Application Data

(60) Provisional application No. 60/322,606, filed on Sep. 17, 2001.

(51) Int. Cl.[7] ..... B05D 3/04; B05D 3/02; B05D 5/00

(52) U.S. Cl. ..... 427/294; 427/296; 427/297; 427/299; 427/314; 427/317; 427/322; 427/325

(58) Field of Search ..... 427/294, 314, 427/299, 322, 296, 317, 325, 297

(56) References Cited

U.S. PATENT DOCUMENTS 2,867,543 A * 1/1959 Braun, Jr. ..... 427/227
4,187,346 A 2/1980 Jarrett
4,190,686 A * 2/1980 Muis ..... 427/317
5,271,164 A * 12/1993 Yoshimura et al. ..... 34/105
6,221,436 B1 * 4/2001 Perry et al. ..... 427/430.1

FOREIGN PATENT DOCUMENTS

| | | |
|---|---|---|
| DE | 201 00 492 | 6/2001 |
| DE | 201 00 504 | 6/2001 |
| WO | WO 86/00041 | 1/1986 |

* cited by examiner

*Primary Examiner*—Michael Barr
(74) *Attorney, Agent, or Firm*—Camoriano and Associates; Theresa Fritz Camoriano; Guillermd Camoriano

(57) ABSTRACT

A process for applying a thermoplastic coating to a substrate wherein the gases and other volatiles in a boundary layer between the substrate and the coating are evacuated using a high volume, high velocity air stream which traverses the surface of the substrate to be coated (functioning as an air knife) such that, when the coating is applied, gases/volatiles do not disrupt the coating while:the coating cools and solidifies. The effect of the air knife may be enhanced by heating the substrate and/or by applying a solvent to the substrate. The air knife also cools down the boundary layer of the substrate so that, as the thermoplastic coating is applied, this cooled-down and gas-evacuated boundary layer provides a measure of insulation between the coating and any gases/volatiles which have not been evacuated from the substrate.

23 Claims, 14 Drawing Sheets

PROCESS FOR APPLYING COATINGS

BACKGROUND OF THE INVENTION

This application claims priority from U.S. Provisional application Ser. No. 60/322,606 filed on Sep. 17, 2001.

The present invention involves forming an envelope or coating over a core that may expel gases and vapors as it is heated during the production process. In many cases, the production of these gases by a wood or other substrate causes poor adhesion of the coating. U.S. Pat. No. 3,432,885 "Zanini", which is hereby incorporated by reference, involves a continuous process for forming an envelope or coating over a core that may expel gases and vapors as it is heated during the production process. Zanini provides bores 22 for the aspiration of gases and vapors that are driven off during the heating, allowing those gases to vent to atmosphere.

SUMMARY OF THE INVENTION

The purpose of the present invention is to improve over Zanini by removing the potential gases and vapors before applying the hot envelope or coating. This removes much of the material that could prevent the coating from attaching uniformly to the surface and creates an insulating layer between the internal portions of the substrate that may still have liquid or resin to prevent those internal materials from vaporizing during the application of the hot surface coating. In most embodiments of the present invention, the substrate is subjected to heating and to a high speed, high volume air stream, which may be created by a vacuum or by a positive pressure air source, followed closely thereafter by the coating. The heat and/or the air stream drive off the gases that would have been formed during the coating process. The air stream also cools down the substrate, so that the internal portions of the substrate will not reach high enough temperatures during the coating process to cause further expulsion of gases.

Wood is used as an example, but this process is applicable to any material which is to become a substrate in a thermal laminating process where that substrate has a tendency to absorb and or contain a moisture or other volatile materials such as resin (sap) which might be volatilized at relatively low temperatures (less than 340 degrees Fahrenheit). We will refer to these materials as hygroscopic materials.

While this process may potentially have the greatest application to a continuous process such as co-extrusion, it is not limited to a co-extrusion process. It could also be used to coat a tabletop or a desktop, a round circle on some surface, or for many other coating arrangements.

Generally, it is not necessary to use supplemental adhesives, as the thermoplastic material itself when heated to the liquid state tends to create an adhesive bond with compatible surfaces. While many hygroscopic materials exist, wood just happens to be a worst case example, because it not only has water, but it also has sap or other chemicals which vaporize during the coating process.

DESCRIPTION OF THE PREFERRED EMBODIMENTS

Figure 1:
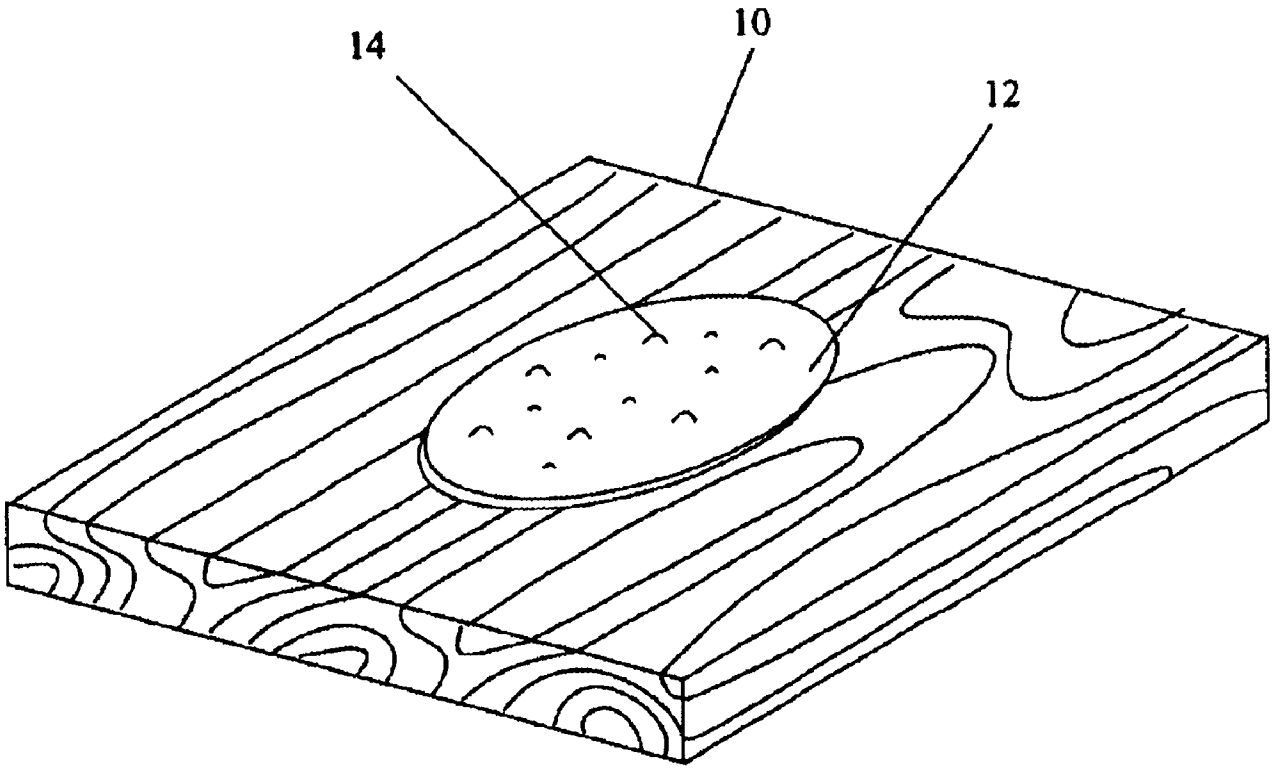
FIG. 1 is a perspective view of a coating on a material where the coating was applied without any pre-treatment.

FIG. 1 is a drawing showing the results of an initial test, in which the volatile materials were not removed from the substrate 10 before applying the coating 12. In this example, a standard pine board 10, which was apparently dry and substantially free of sap, was used. With the surface in a horizontal position, a thin coat of thermoplastic 12, which had been heated to the liquid temperature, was poured onto the surface 10 over an area that was two inches in diameter. Before the thermoplastic 12 could solidify, the heat from the thermoplastic vaporized the moisture content on the surface of the pine board 10, resulting in blisters 14 in the thermoplastic surface 12, some of which burst and some of which did not, resulting in a very ugly, rough surface as the thermoplastic 12 cooled.

Figure 2:
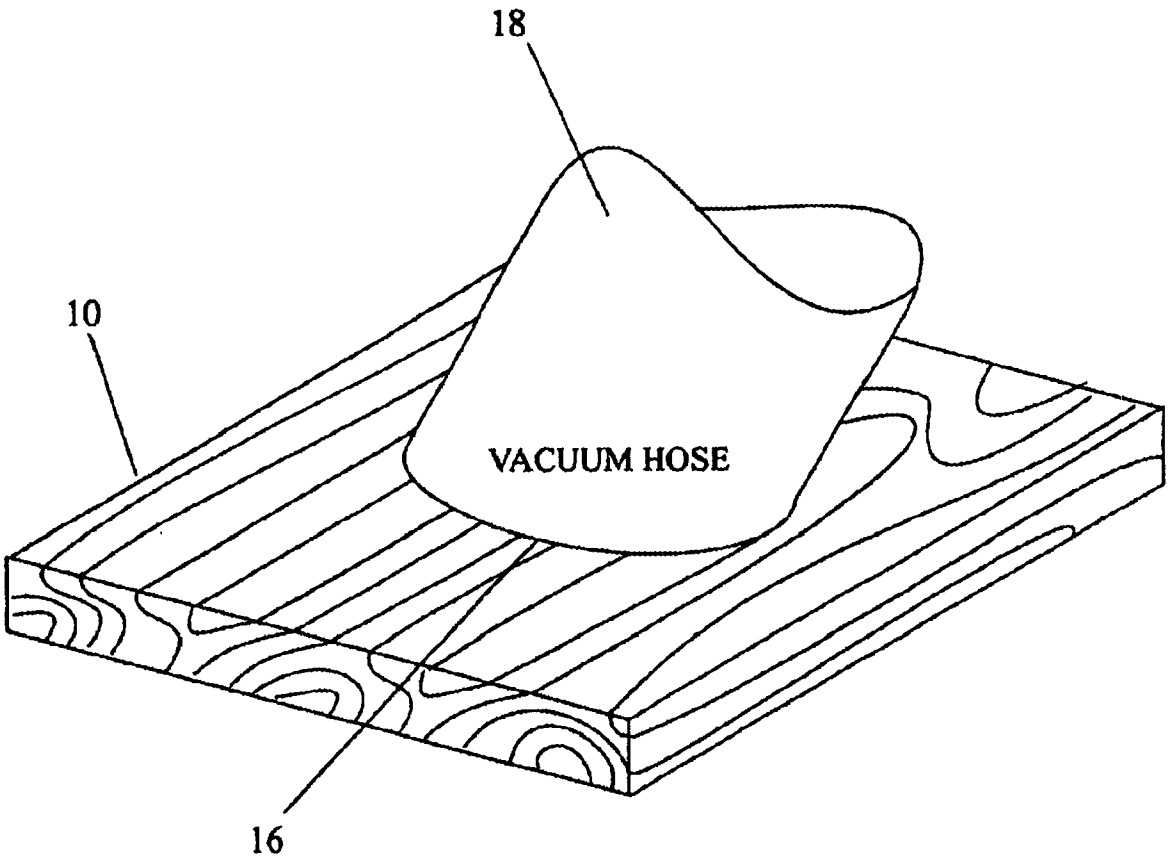
FIG. 2 is a perspective view of the same material as in FIG. 1, but being pretreated with vacuum from a vacuum hose.
Figure 3:
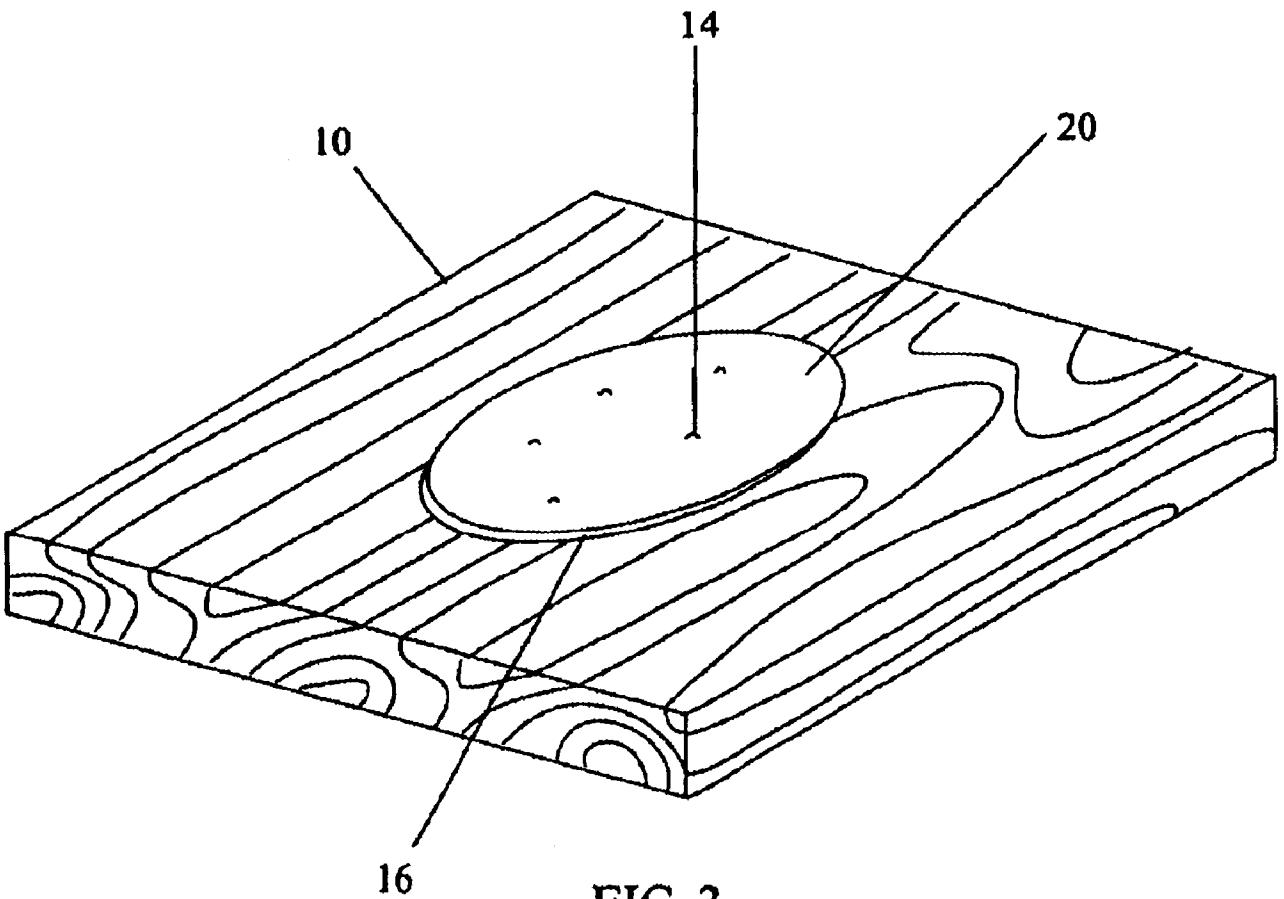
FIG. 3 is the same view as in FIG. 1, but where the coating was applied after the pre-treatment shown in FIG. 2.

As shown in FIGS. 2 and 3, another spot 16 on the same board 10 was selected in close proximity to the first spot 12 of FIG. 1 The standard round hose fitting 18 on a household vacuum was applied to that spot 16 for approximately two minutes while the vacuum was running. Immediately after removing the vacuum from the surface 16, a thin coat of melted thermoplastic 20 was applied, as in FIG. 1. There was a substantial reduction in the amount of bubbles or blisters 14 created prior to the cooling of the thermoplastic 20.

Figure 4:
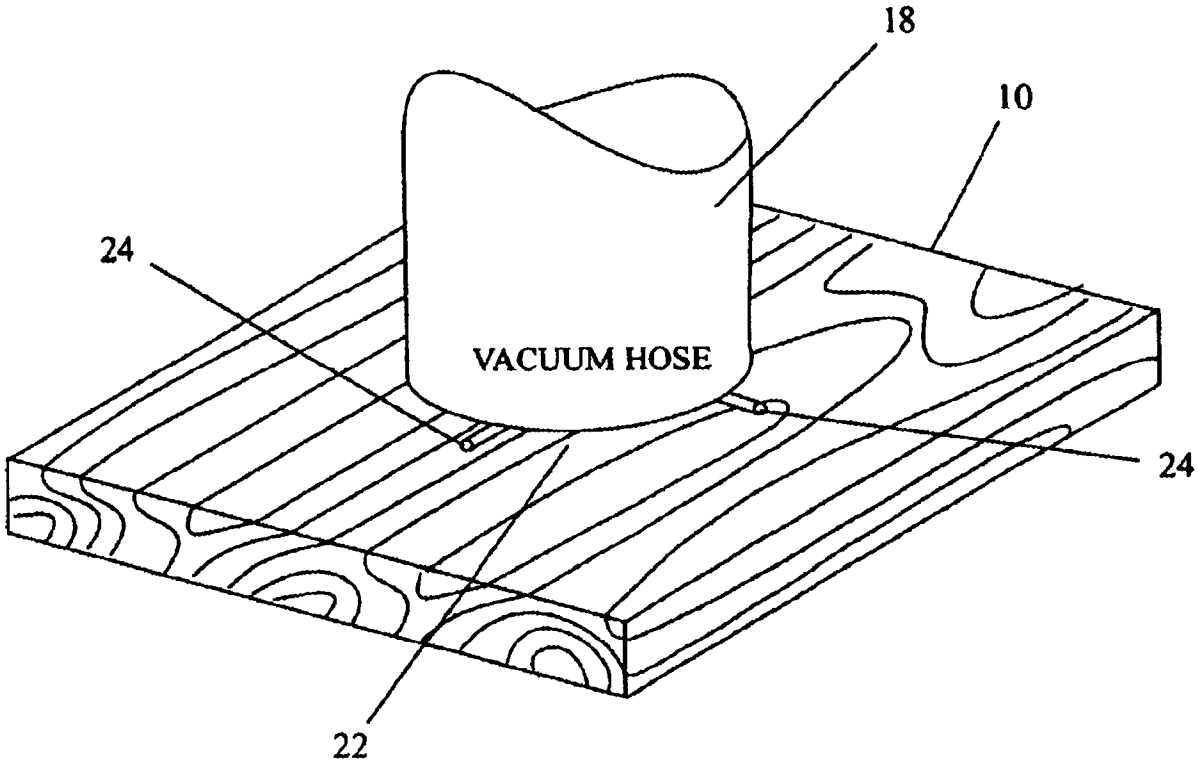
FIG. 4 is a perspective view of the same material as in FIG. 1, but being pretreated with vacuum from a vacuum hose, similar to that in FIG. 2, except that the vacuum hose is maintained a fixed distance above the surface of the material by means of wire spacers.
Figure 5:
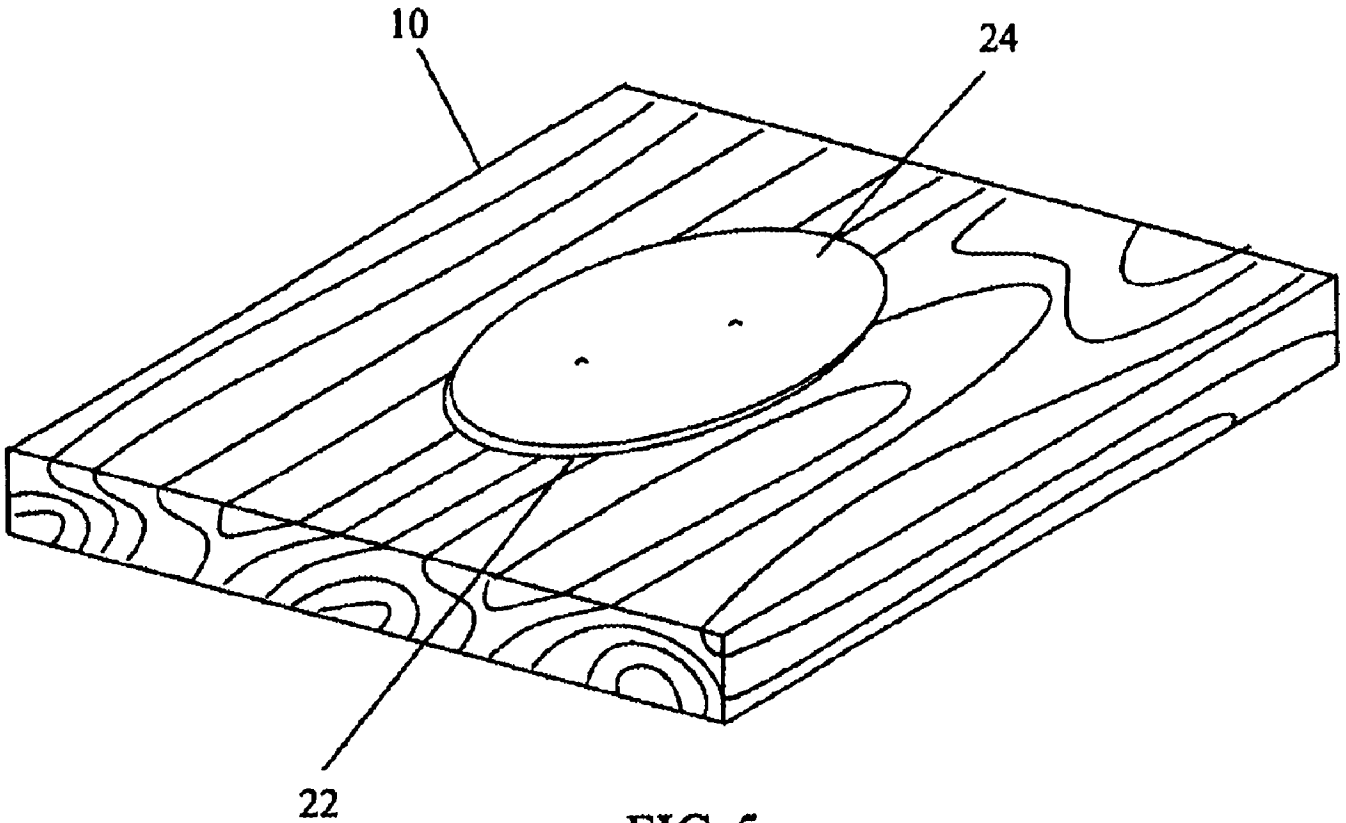
FIG. 5 is the same view as in FIG. 1, but where the coating was applied after the pre-treatment shown in FIG. 4.

As shown in FIGS. 4 and 5, yet another spot 22 on the same board 10 was s elected as in the previous two examples. Two perpendicular pieces of wire 24 approximately 0.010 inches in diameter were placed on the spot 22 of the board 10, with each wire 24 forming a diameter of the circle to be vacuumed. Then the vacuum hose 18 was applied to the area 22. The pieces of wire 24 held the vacuum hose 18 off the surface 22 of the substrate 10 by approximately 0.010 inches. This resulted in an extremely high velocity air stream created over the surface 22. The thermoplastic 24 was again applied as in the earlier examples. The coating 24 was greatly improved over that shown in FIGS. 1 and 3, with the greatest improvement around the circumference of the circle 22.

Figure 6:
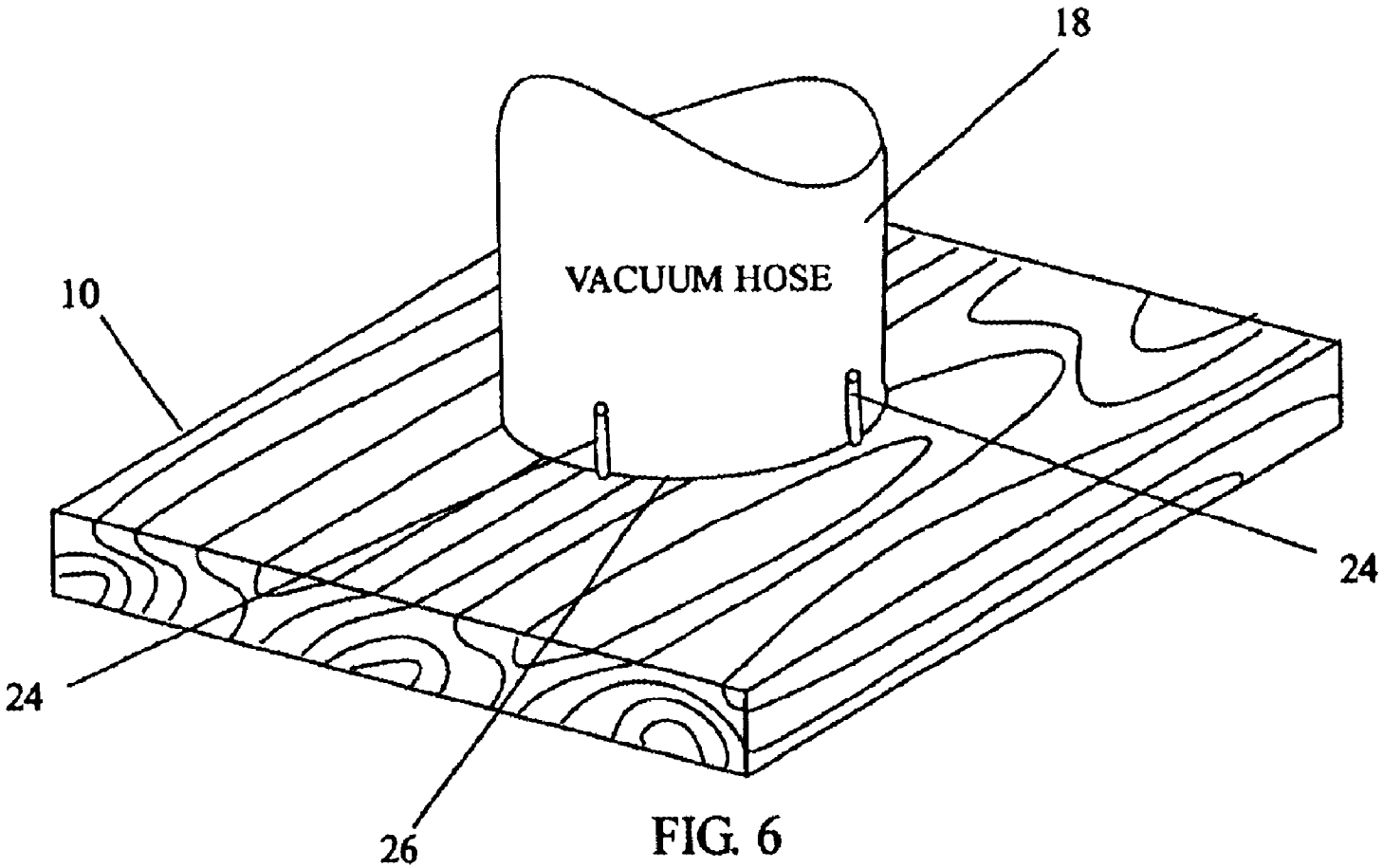
FIG. 6 is a perspective view of the same material as in FIG. 4, but the wire spacers are secured to the end of the vacuum hose so the hose may be moved along the surface of the material while remaining a fixed distance above the material, creating an air-knife effect.
Figure 7:
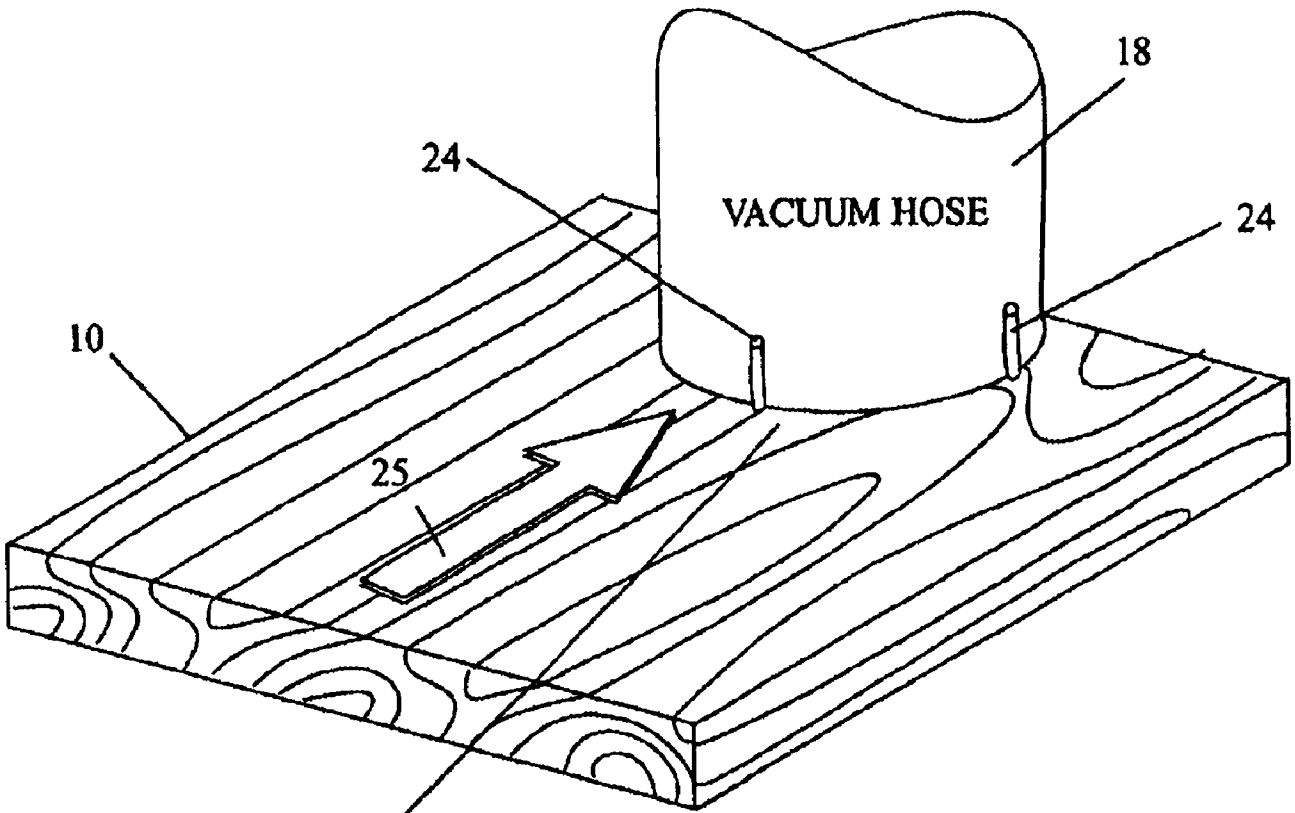
FIG. 7 is a perspective view of the vacuum hose, with the wire spacers of FIG. 6, being moved across the surface of the material.
Figure 8:
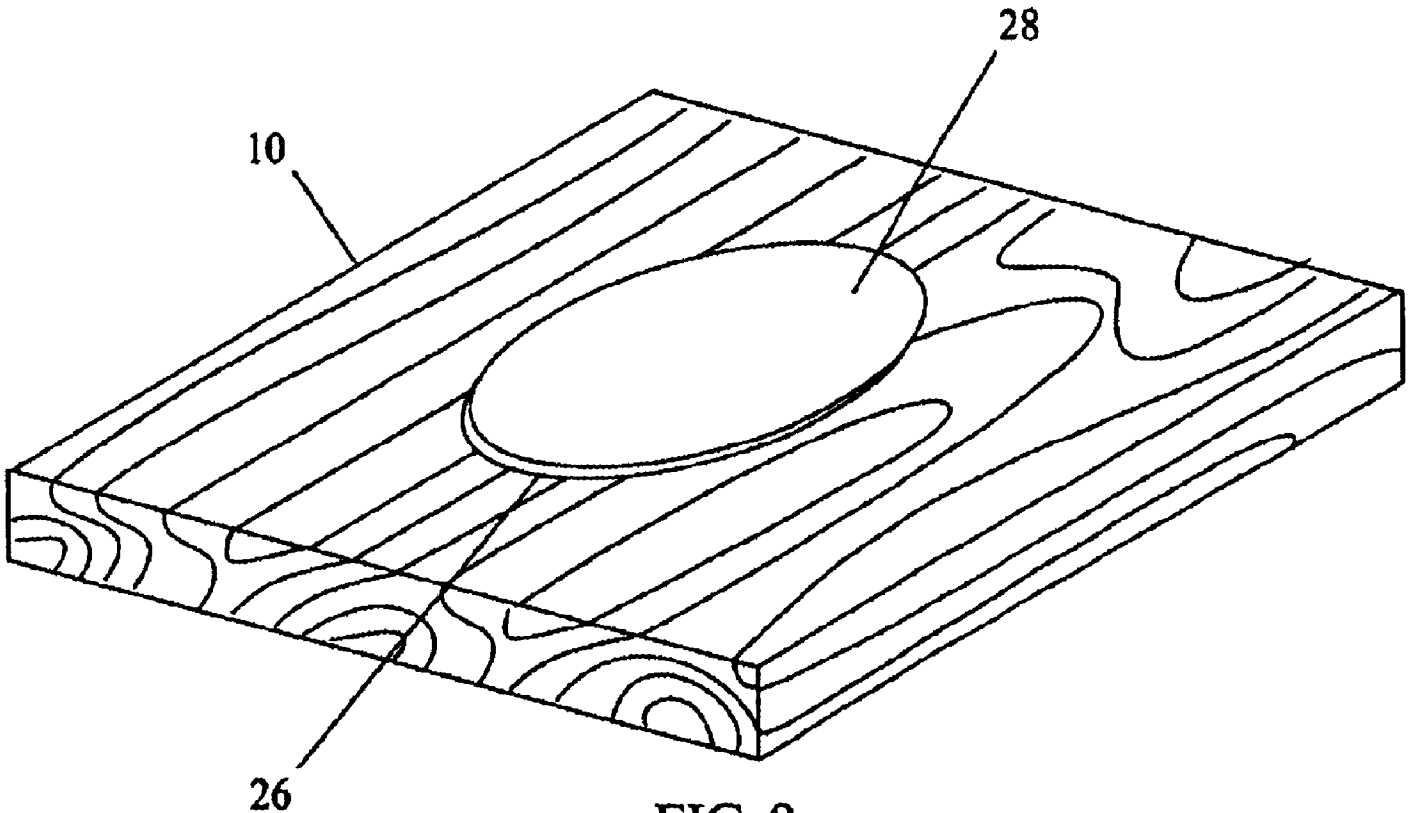
FIG. 8 is the same view as in FIG. 1, but where the coating was applied after the pre-treatment shown in FIG. 7.

As shown in FIGS. 6–8, yet another spot 26 on the board 10 was selected, and the arrangement was the same as in FIG. 4, except that the crossed wires 24 were attached to the vacuum hose 18 by bending them up along the outside of the vacuum hose 18 and taping them in place. Then, the hose 18 was placed on the board 10 in the selected position 24, and, while the vacuum was being applied, the hose 18 was slowly moved in the direction of the arrow 25 shown in FIG. 7, exposing the entire surface of the selected area 26 directly to this high velocity air stream, acting as an air knife. (The term air knife refers to a high volume, high velocity air stream traversing the surface of a substrate. The high volume, high velocity air flow is maintained along the surface of the substrate by maintaining a small, controlled gap between the air flow device and the substrate as the air flow device moves relative to the substrate or as the substrate moves relative to the air flow device.) Then, the thermoplastic coating 28 was applied. As shown in FIG. 8, the resulting surface, when cooled, was the best surface, without any vapor-generated disfigurement.

What was accomplished in the examples using the air-knife appears to be removal of the water molecules from the surface of the wood 10 and for some slight depth, creating a boundary layer. In the process of removing the water molecules, the cells of the wood within this boundary layer were opened and evacuated. The evacuated wood cells then created an insulating barrier between the applied thermoplastic and the interior part of the substrate 10 which still contained moisture, thereby preventing the interior, moist portions of the substrate 10 from being elevated to a high enough temperature to vaporize before the surface thermoplastic had an opportunity to cool. In addition, the opened cellular structure of the substrate forms a stronger bond with the applied thermoplastic film. It is interesting to note that a vacuum alone, as shown in FIGS. 2 and 3, provided some improvement over an untreated substrate (as shown in FIG. 1). However, it is the air-knife principle, as shown in FIGS. 4 and 5, and even more dramatically in FIGS. 6 through 8, which makes a marked improvement in the quality of the coated surface. The high speed, high volume air stream across the substrate surface aids in removing volatiles and in cooling the substrate surface to be coated. The vacuum hose is a convenient method of accomplishing the air-knife principle, but this same result can be obtained by blasting the surface with positive air pressure across a small gap, which also creates a high volume air stream across the surface. The effectiveness and the depth of this boundary layer may be enhanced, as has been discussed above, by heating the substrate and/or by applying a solvent to the substrate.

If the thermoplastic film mentioned here were in fact applied under a significant positive pressure (preferably more than 50 lbs. per square inch), then the adhesive bond between the thermoplastic and the substrate 10 would be enhanced even further. (The higher the pressure, the better the bond).

A test of the quality of the bond being formed in the above experiments could be made by pulling away the thermoplastic skin after it has been cooled. The result would show a progressively better bond from FIG. 1 to FIG. 8.

Repeating the above experiments in an area of the pine board 10 which contains a small to moderate amount of sap, there is an even more dramatic improvement observed between FIGS. 3 and 5. This is because the more viscous sap does not react as favorably to the negative pressures generated by the household vacuum until the higher velocities and air-knife principle are used (although it would react favorably to much higher negative pressures which could be generated by an industrial vacuum).

The application of a relatively low level of heat (preferably heating the surface of the substrate 10 to be coated to temperatures of 280–320 degrees Fahrenheit) reduces the viscosity of the sap to the point that its removal is significantly facilitated even with relatively low vacuum pressures, and especially in the presence of the air-knife.

If only water is present in the substrate 10, then raising the surface temperature above 212 degrees Fahrenheit to vaporize the water facilitates the vacuuming process. However, if sap is present, the surface temperature preferably should be raised even higher to volatize the sap (approximately 300 degrees Fahrenheit) and facilitate the evacuation process.

It is also true that it is desirable to heat the surface of the substrate 10 to the 300 degree Fahrenheit range even if only water is present, because the higher this surface temperature, the greater the depth of penetration of the 212 degree Fahrenheit temperature. This results in water being vaporized for a greater depth from the surface. Then, when this surface is cooled prior to coating, the substrate 10 withstands a higher temperature from the thermal coating before vaporizing occurs, because there is a thicker insulating layer present and because higher flash point materials have also been pre-vaporized.

Figure 9:
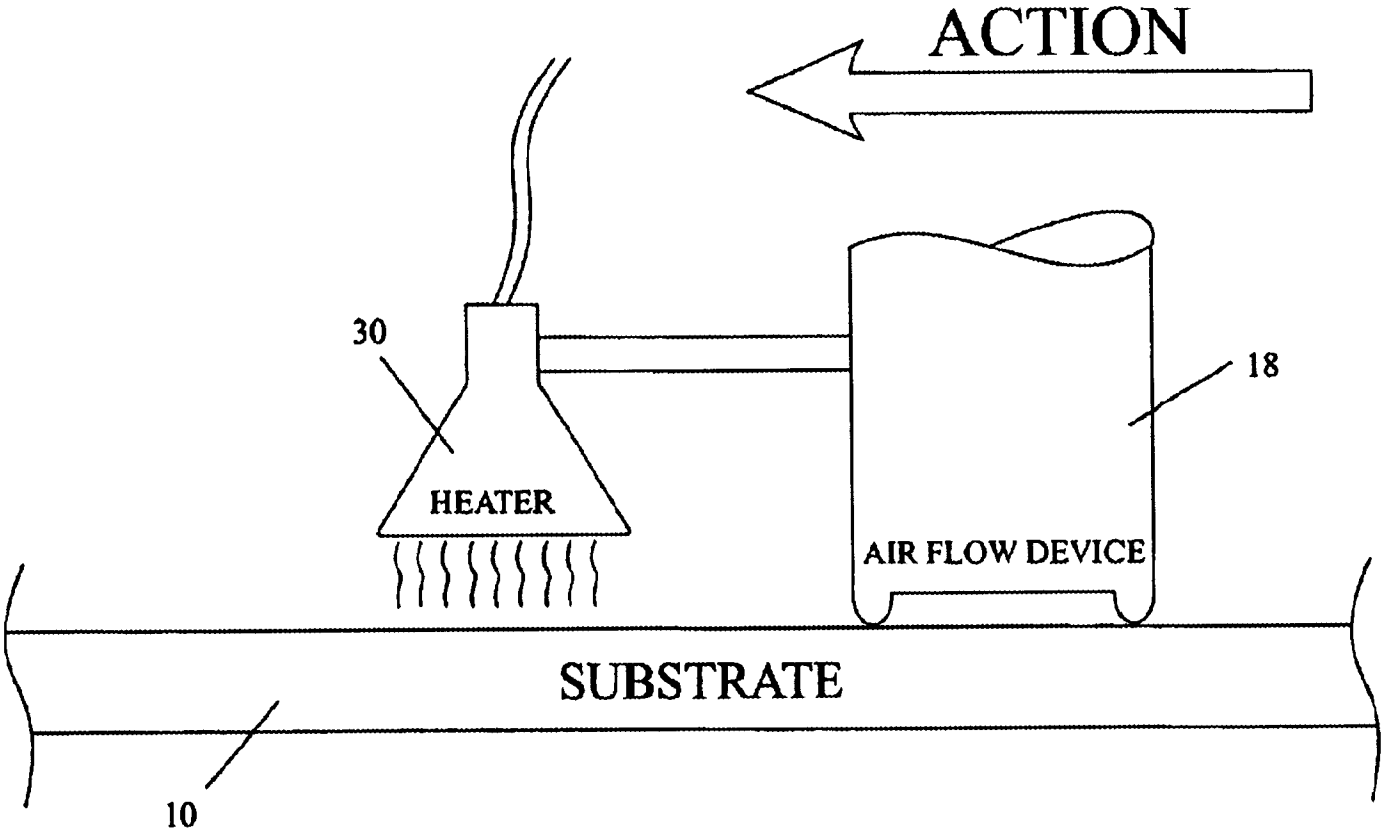
FIG. 9 is a schematic view of a device for pre-treating a substrate, such as the material shown in FIGS. 1 through 8, wherein heat is applied to the area to be coated just before the area is treated with an air knife which is represented by an air flow device raised just above the surface of the substrate to be coated.

Although there are many ways to induce heat, one simple way is with an industrial infrared heat lamp designed to direct its energy onto the desired surface. After heating, the high volume, high velocity air flow device or air-knife (either using vacuum or positive pressure) preferably would then be applied as in FIG. 6. This heating and high velocity air process is shown in FIG. 9, with the industrial infrared lamp 30 mounted to the air-knife 18 so they move together as a unit over the surface to be coated.

Figure 10:
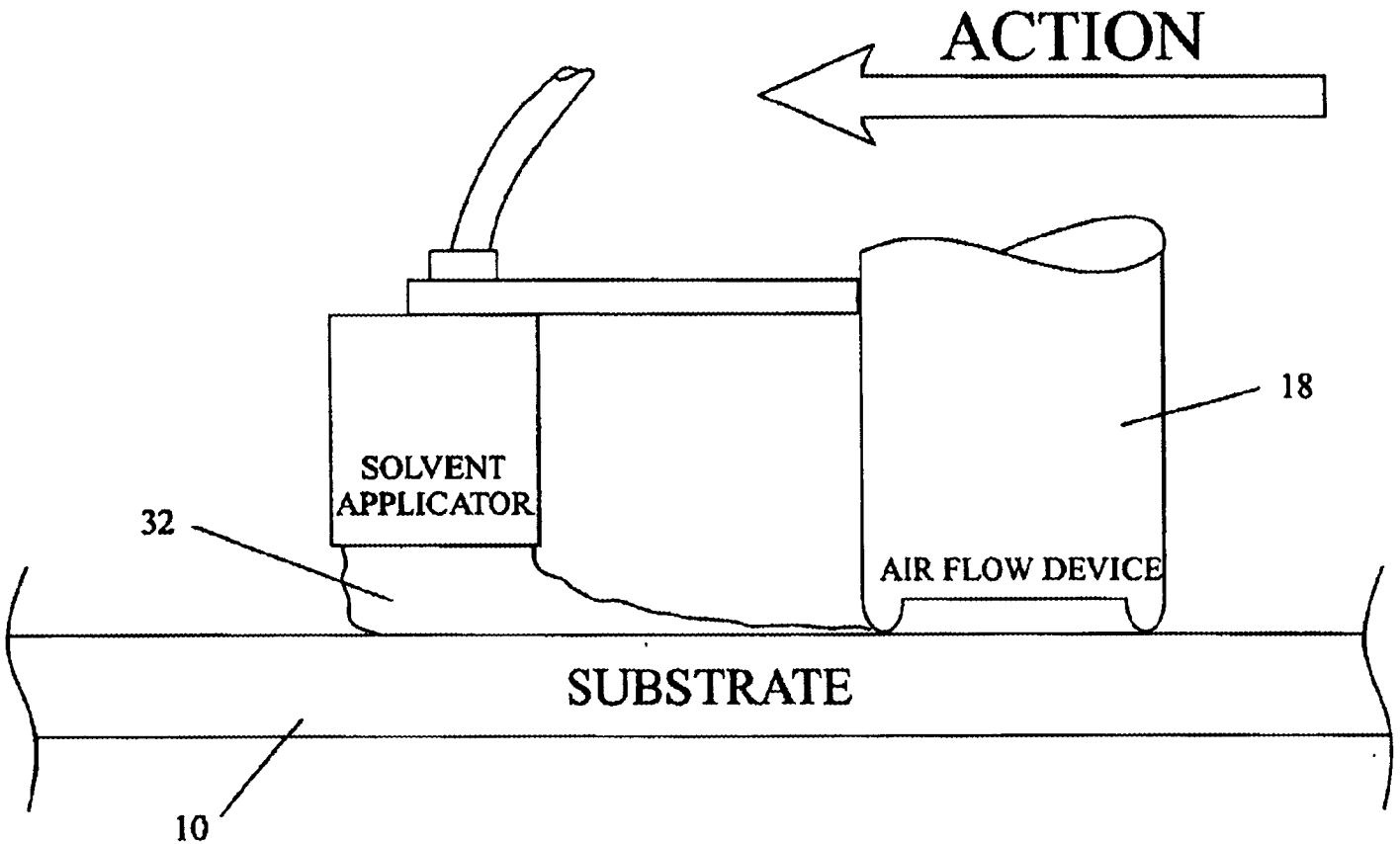
FIG. 10 is a schematic view of a device for pre-treating a substrate, very similar to the device shown in FIG. 9, except the heater is replaced with a solvent applicator.

Another way to facilitate the removal of the rather viscous sap, as shown in FIG. 10, is to apply a solvent 32 to the surface of the substrate 10 prior to the air-knife step. Since the action of the solvent 32 reduces the viscosity of the sap, it facilitates the removal of the sap with the air flow device 18 (which again may be either a vacuum device or a positive pressure device, or a combination device which sequentially applies a vacuum and then a positive pressure).

It is also desirable to reduce the temperature of the surface of the substrate 10 prior to applying the thermoplastic coating. The surface temperature of the substrate 10 should be reduced to below 180 degrees Fahrenheit, preferably below 130 degrees Fahrenheit, and most preferably to at least 100 degrees Fahrenheit before entering the coating process, although success has been achieved at higher temperatures. By cooling the substrate 10 prior to applying the coating, a heat sink and insulating barrier is created between the liquid thermoplastic and the moisture laden interior of the substrate 10, which will give the thermoplastic time to cool to 200 degrees or lower and to solidify and bond to the substrate 10 prior to raising the interior moisture to a high enough temperature to vaporize. It is not desirable for the temperature of the substrate to be too low, because it may cause the surface of the liquid thermoplastic coming into contact with the substrate 10 to solidify prior to having an opportunity to fully integrate to the cellular structure of the surface of the substrate 10. In this process, with the thermoplastics which have been tested so far, it is generally not preferable for the substrate 10 to be at a temperature lower than 60 degrees Fahrenheit when the thermoplastic is applied.

Figure 11:
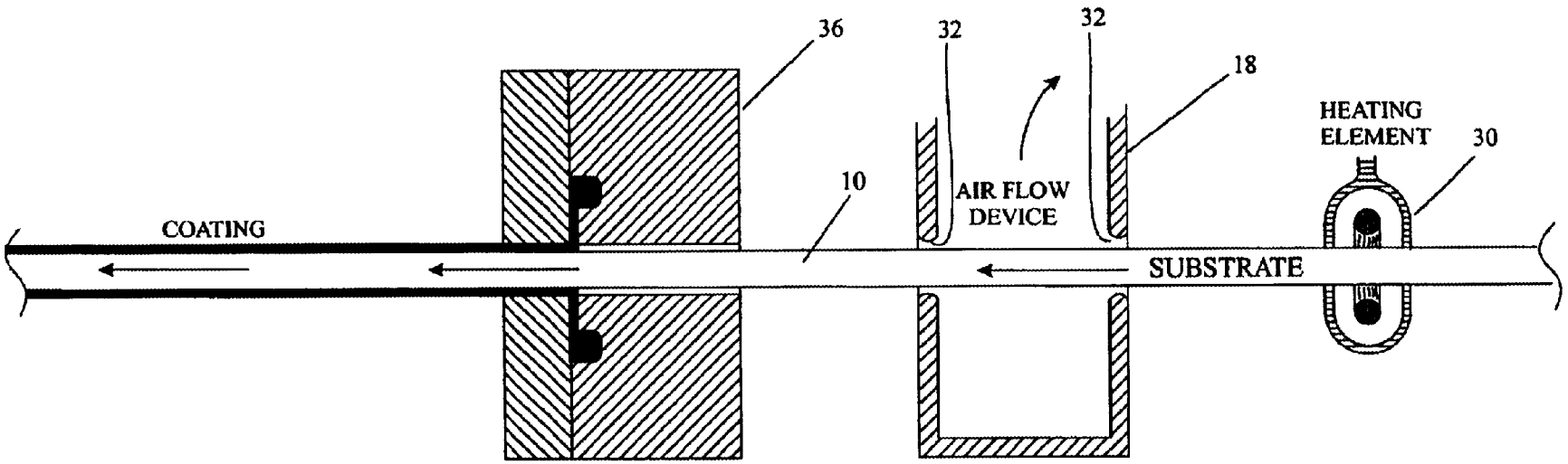
FIG. 11 is a schematic view of a device for continuously pre-treating and coating both sides of a substrate, using the pre-treatment depicted in FIG. 9, namely a combination of heating and an air knife.
Figure 12:
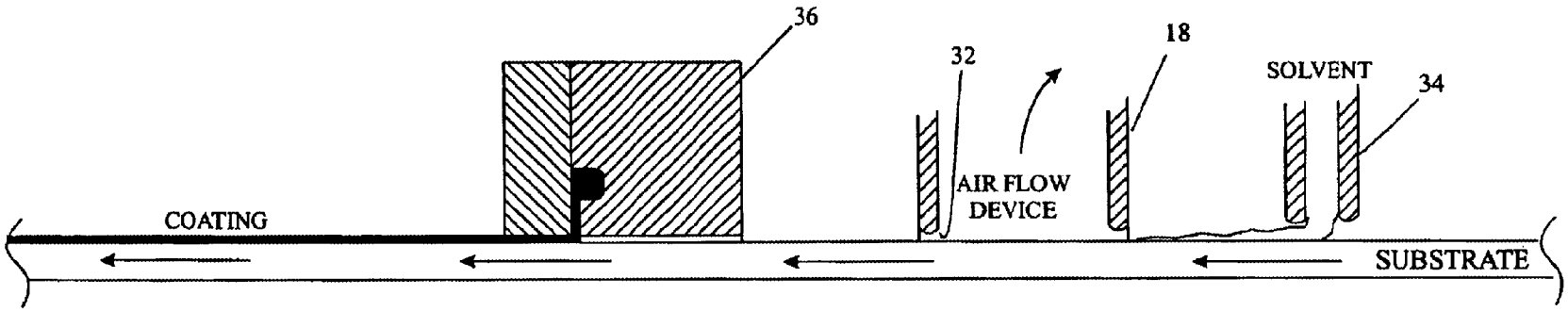
FIG. 12 is a schematic view of a device for continuously pre-treating and coating one side of a substrate, using the pre-treatment depicted in FIG. 10, namely a combination of solvent application and an air knife.

FIGS. 11 and 12 show coating processes being applied to a large flat surface 10, which could be a table, desk, countertop, or even a floor. The high velocity/high volume air flow device 18 is made so as to permit relative motion between the device 18 and the surface of the substrate 10 as described in relation to FIG. 6, with a closely controlled gap 32 between the device 18 and the surface being prepared in order to direct the high velocity/high volume air flow onto the surface of the substrate 10. In these embodiments, the air flow device 18 is fixed, and the surface being prepared is moved in relation to the air flow device 18. However, the process could be modified so that the air flow device moves and the substrate is stationary.

In FIG. 11, a heating element 30 is attached to or arranged in proximity to the air flow device 18 so that the heating element 30 precedes the high volume/high velocity air flow device 18 in exposure to the substrate 10, and the coating follows the exposure to the air knife 18. The air flow device 18 removes the volatiles and cools the substrate 10 down to the desired temperature after the heat is applied.

In FIG. 12, instead of using the heating element, a solvent 34 is applied.

Figure 13:
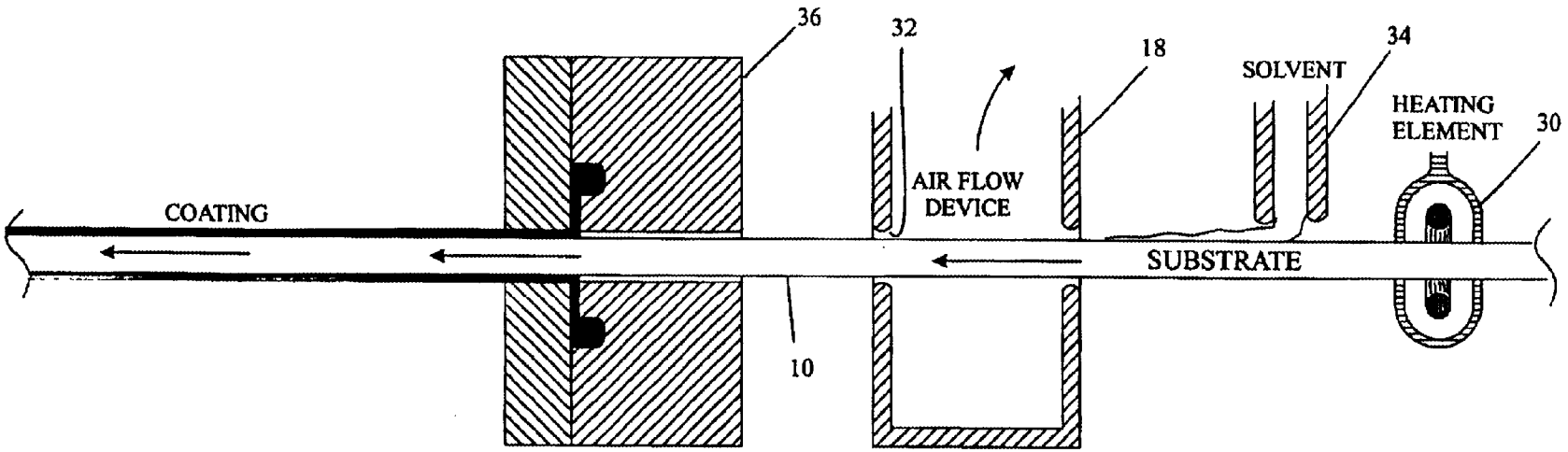
FIG. 13 is a schematic view of a device for continuously pre-treating and coating both sides of a substrate, using the pre-treatment similar to that in FIG. 12, except that it is preceded by a heating step.
Figure 14:
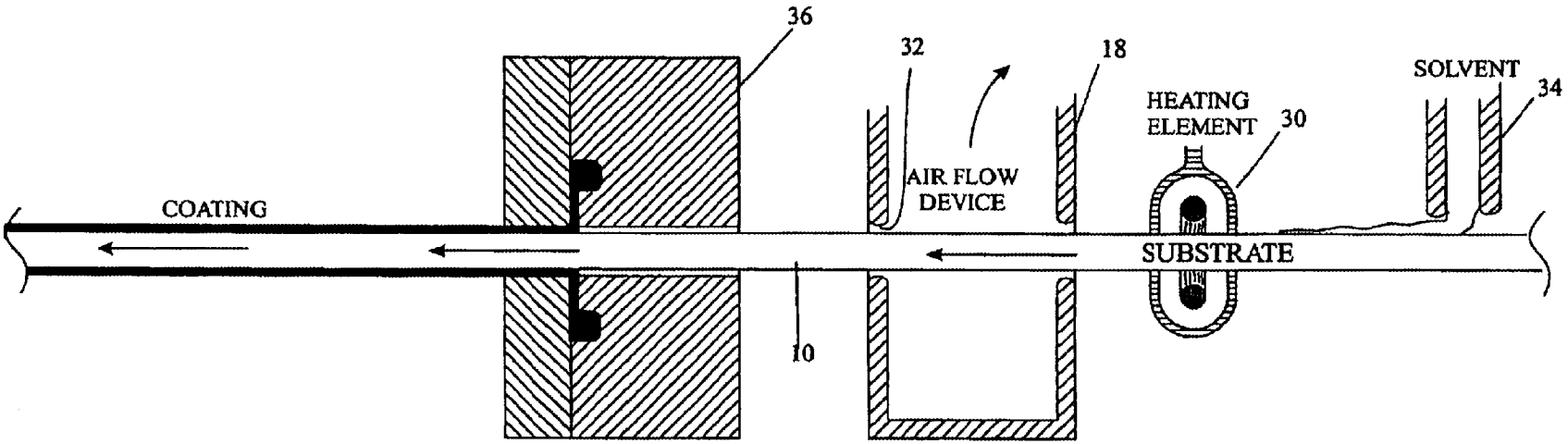
FIG. 14 is a schematic view of a device for continuously pre-treating and coating both sides of a substrate, using the pre-treatment similar to that in FIG. 13, except that the solvent application precedes the heating step.

It would also be possible to apply both heat and solvent followed by application of the air knife 18, as shown in FIGS. 13 and 14.

A thermoplastic application device 36 preferably is located in close proximity to the high air flow device 18 in order to coat the treated surface of the substrate 10 after the surface preparation. Each of the steps of this process can be done very quickly, in a few seconds, so that the entire process can take less than a minute.

The surface preparation process could take place in its own step on the substrate 10, and the substrate 10 could then be stored and re-handled, prior to coating with the thermoplastic. However, better results can be expected if the thermoplastic application takes place as soon after the application of the high velocity/high volume air stream as is physically possible, because most materials which would require this type of treatment are hygroscopic by nature, and the longer the dwell time between vacuum and thermoplastic application, the more likely they would be to re-acquire moisture. Also, the air-knife process itself tends to lower the surface temperature of the substrate 10 and, in the interest of efficiency, it would be good to use this lowered surface temperature, especially if it were lower than ambient temperature as has been described above.

This process technology may be applied in a continuous lineal process, with either the substrate moving past the process elements or with the process elements moving along the substrate.

In the processes of FIGS. 13 and 14, the preparatory heating 30 and solvent 34 applications are located in advance of the high volume air flow zone 18, and the entire apparatus is located in as close proximity as possible to the thermoplastic coating device 36 so that the prepared surface 10 is in its optimum condition when the thermoplastic is applied.

Although the foregoing processes may be used on any type of wood or hygroscopic material, we have in practice found that we have greater success with less dense woods and those that have greater uniformity and less sap content. As the characteristics of the substrate are closer to optimum, fewer and less extreme preparation steps may be used. For example, it may be possible to use lower air flow (or no air flow), to use lower temperature heat application (or no heat application) and fewer or no solvents with more optimum substrates than with less optimum substrate materials.

For instance, in a close to ideal situation, a uniform, low density wood is used. The thermoplastic coating is polypropylene, which is heated and extruded so that it is applied at a temperature in the range of 320–350 degrees F. The extruding pressure is approximately 300 pounds per square inch (psi). (It is thought that pressures in the range of 200–400 psi are preferable.) The substrate preparation includes heating and application of high speed/high volume air flow stream prior to coating, as in FIGS. 9 and 11. The substrate 10 prior to application of the air knife was raised to a temperature anywhere from 225 degrees to 320 degrees Fahrenheit. The high speed/high volume air flow in this instance was created by applying a vacuum of 0.8 atmospheres for a distance of approximately 18" with a gap of 0.01 inches, which means the substrate 10 was subjected to this high speed air flow for approximately 9 seconds (at the finished product rate of 10 feet per minute). This level of air flow caused the surface temperature to be reduced from a temperature of 230 degrees F. to approximately 125 degrees F. Or, if the substrate 10 entered at 275 degrees F., it exited at approximately 130 degrees F.

Additional positive pressure dry air stream cooling was applied to the surface between the vacuum head and the coating station, which further reduced the surface temperature to approximately 110 degrees F. to 115 degrees F. The surface of the coated substrate 10 approximately 1" from the die plate on the exit side, under the above described conditions, had a temperature of approximately 270 degrees Fahrenheit. Under these conditions, a good, blister free product was produced.

The entire process may be set up to produce a finished product at a rate of approximately 10 feet per minute. There may have to be slight modifications to temperature and pressure settings on the extruder as well as the substrate preparation equipment in order to facilitate different extrusion output speeds.

Factors which could degrade the quality of the coated surface, creating more blisters, include:

- Raising the temperature of the substrate 10 at the point of application of the coating such that the exit temperature of the product at the die plate is well in excess of 270 degrees F.
- Reducing the temperature achieved on the substrate 10 prior to entering the airflow chamber.
- Elevating the temperature of the substrate 10 at the time of entry to the coating station.
- Reducing the amount of air flow applied.

Keeping all other elements equal, a tar solvent was applied to the substrate 10 prior to heating. By wiping the solvent on and quickly wiping it off with a rag, a slight improvement was found in the process (slight improvement measured in that some of the above mentioned factors may be moved slightly in the unfavorable direction and still result in an acceptable coated surface). It is reasonable to expect that if the surface to be coated is subjected to the solvent for a longer period of time prior to removal, the improvement would be more dramatic.

While several embodiments of the present invention have been shown and described, it is not practical to describe all the possible variations and combinations that could be made within the scope of the present invention. It will be obvious to those skilled in the art that modifications may be made to the embodiments described above without departing from the scope of the invention as claimed.

What is claimed is:

1. A process for applying a thermoplastic coating to a hygroscopic substrate having a surface, a subsurface, and an interior, comprising the steps of:

applying an air knife which generates a high volume, high velocity air flow along the surface of the substrate, while maintaining a small, controlled gap between the air knife and the substrate and while providing relative movement between the air knife and the substrate so as to remove volatile materials from the surface and subsurface of the substrate, thereby forming an evacuated insulating boundary layer between the surface of the substrate and the interior of the substrate; and then applying a thermoplastic coating to the substrate.

2. A process for applying a thermoplastic coating to a hygroscopic substrate, comprising the steps of:

heating the substrate; then applying an air knife along the heated substrate to remove gases and cool the substrate; and then applying a thermoplastic coating to the substrate.

3. A process as recited in claim 2, in which the air knife includes a vacuum device.

4. A process as recited in claim 2, in which the air knife includes a positive pressure air flow device.

5. A process as recited in claim 3, in which the air knife moves relative to the substrate.

6. A process as recited in claim 3, in which the substrate moves relative to the air knife.

7. A process as recited in claim 4, in which the air knife moves relative to the substrate.

8. A process as recited in claim 4, in which the substrate moves relative to the air knife.

9. A process as recited in claim 2, wherein there is a gap between the air knife and the substrate of approximately 0.010 inches.

10. A process for applying a thermoplastic coating to a hygroscopic substrate having a surface, a subsurface, and an interior, comprising the steps of:

applying a solvent to the substrate; then applying an air knife which Generates a high volume, high velocity air flow along the surface of the substrate, while maintaining a small, controlled gap between the air knife and the substrate and while providing relative movement between the air knife and the substrate, thereby removing volatile materials from the surface and subsurface of the substrate and forming an evacuated, insulating boundary layer between the surface of the substrate and the interior of the substrate; and then applying a thermoplastic coating to the substrate.

11. A process as recited in claim 10, in which the air knife includes a vacuum device having a small gap between the vacuum device and the substrate.

12. A process as recited in claim 10, in which the air knife includes a positive pressure device having a small gap between the positive pressure device and the substrate.

13. A process as recited in claim 11, wherein said gap is approximately 0.010 inches.

14. A process as recited in claim 12, wherein said gap is approximately 0.010 inches.

15. A process for applying a thermoplastic coating to a hygroscopic substrate, comprising the steps of:

heating the substrate and applying a solvent to the substrate; then applying an air knife along the substrate to remove gases and cool the heated substrate; and then applying a thermoplastic coating to the substrate.

16. A process as recited in claim 15, in which the air knife includes a vacuum device having a small gap between the device and the substrate.

17. A process as recited in claim 15, in which the air knife includes a positive pressure device having a small gap between the device and the substrate.

18. A process as recited in claim 2, wherein the surface of the substrate is heated to a temperature between 225 and 350 degrees Fahrenheit in the heating step.

19. A process as recited in claim 15, wherein the surface of the substrate is heated to a temperature between 225 and 350 degrees Fahrenheit in the heating step.

20. A process as recited in claim 18, wherein the surface of the substrate is cooled to a temperature below 180 degrees Fahrenheit prior to applying the thermoplastic coating.

21. A process as recited in claim 19, wherein the surface of the substrate is cooled to a temperature below 180 degrees Fahrenheit prior to applying the thermoplastic coating.

22. A process for applying a thermoplastic coating to a hygroscopic substrate, comprising the steps of:

heating the surface of the substrate to a temperature in the range of 225–350 degrees Fahrenheit; then applying an air knife along the surface of the heated substrate to remove gases and cool the surface of the substrate to a temperature below 180 degrees Fahrenheit; and then applying a thermoplastic coating to the surface of the substrate.

23. A process as recited in claim 22, and further comprising the step of applying a solvent to the substrate prior to applying the high volume, high speed air flow.

* * * * *